US005896718A

United States Patent [19]

Westgarth

[11] Patent Number: 5,896,718

[45] Date of Patent: Apr. 27, 1999

[54] COLLAPSIBLE PANEL AND MODULAR ENCLOSURE AND PARTITION SYSTEM

[76] Inventor: Peter Westgarth, 452 Black St., Fergus, Ontario, Canada, N1M 3M7

[21] Appl. No.: 08/755,900

[22] Filed: Nov. 25, 1996

[51] Int. Cl.[6] ..... E04H 12/18

[52] U.S. Cl. ..... 52/646; 52/656.9; 52/648.1

[58] Field of Search ..... 52/645, 646, 656.9, 52/79.5, 222, 641, 648.1, 655.1; 5/93.1, 98.1, 99.1

[56] References Cited

U.S. PATENT DOCUMENTS

| | | | |
|---|---|---|---|
| 3,710,806 | 1/1973 | Kelly et al. | 52/645 X |
| 4,970,841 | 11/1990 | Zeigler | 52/646 |
| 5,040,349 | 8/1991 | Onoda et al. | 52/645 X |
| 5,163,262 | 11/1992 | Adams | 52/645 X |
| 5,327,700 | 7/1994 | Sorenson et al. | 52/645 X |
| 5,596,843 | 1/1997 | Watson | 52/222 X |
| 5,647,176 | 7/1997 | Milliken et al. | 52/222 X |
| 5,651,228 | 7/1997 | Zeigler | 52/646 |

*Primary Examiner*—Carl D. Friedman
*Assistant Examiner*—Beth Aubrey
*Attorney, Agent, or Firm*—Dimock Stratton Clarizio; Mark B. Eisen

[57] ABSTRACT

A collapsible panel particularly suitable for a partition or enclosure system. In the preferred embodiment each panel has a flexible membrane affixed to an extruded frame, the corners of the frame having hinges which alternately fold along the plane of the frame and perpendicular to the plane of the frame. The frame is thus collapsible in two directions so as to collapse to a very small cross-sectional area, and when the panel is opened the membrane is pulled taught, which imparts structural integrity to the panel and prevents billowing of the membrane in windy conditions. Connecting elements are also provided so that the panels can be connected together to form a self-standing enclosure, or affixed to scaffolding or any other suitable frame structure.

16 Claims, 8 Drawing Sheets

Fig. 1a
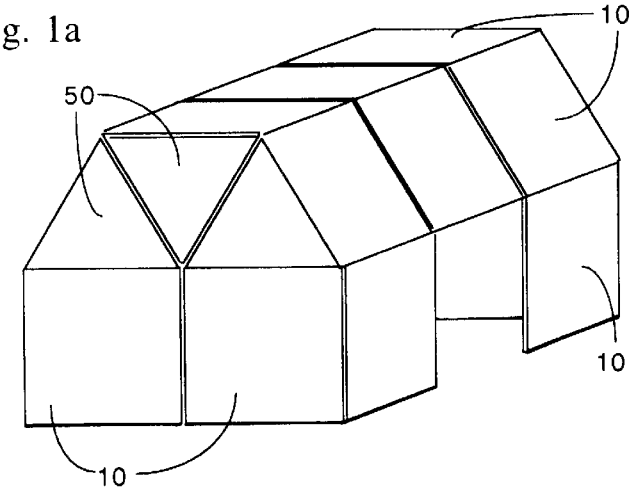
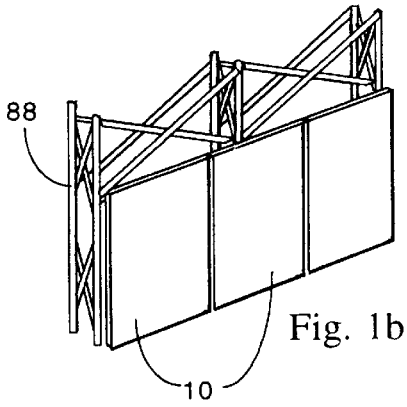
Fig. 1b
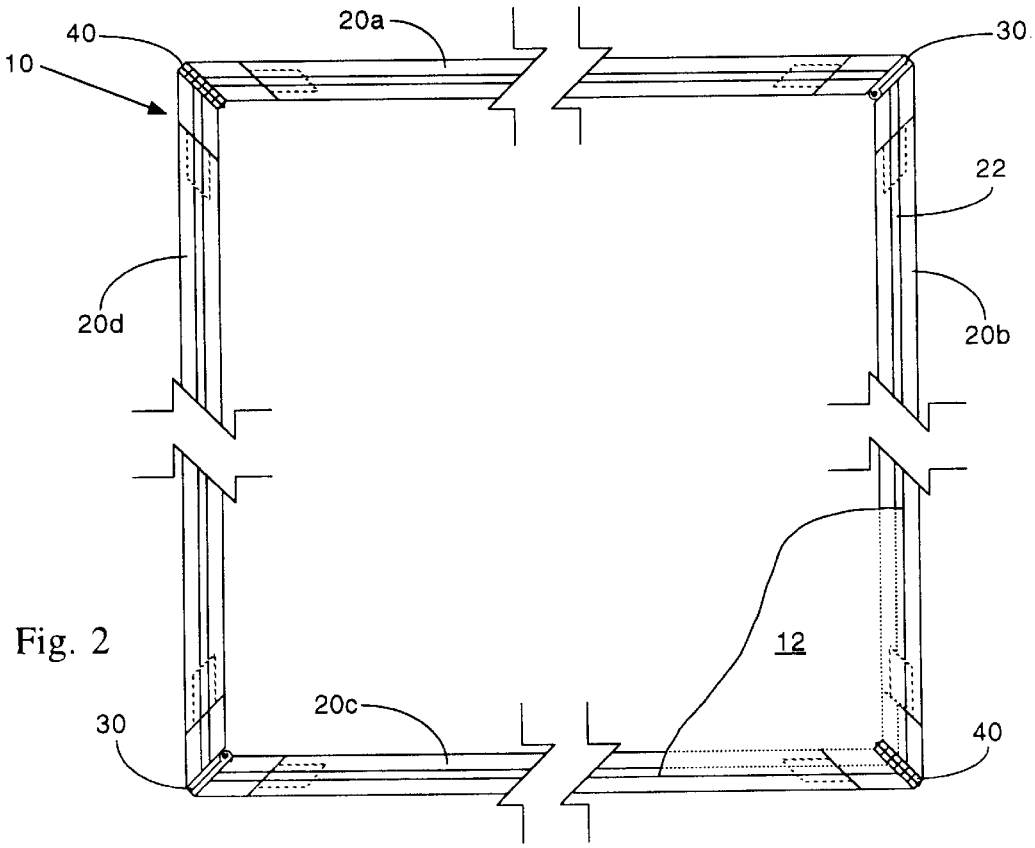
Fig. 2

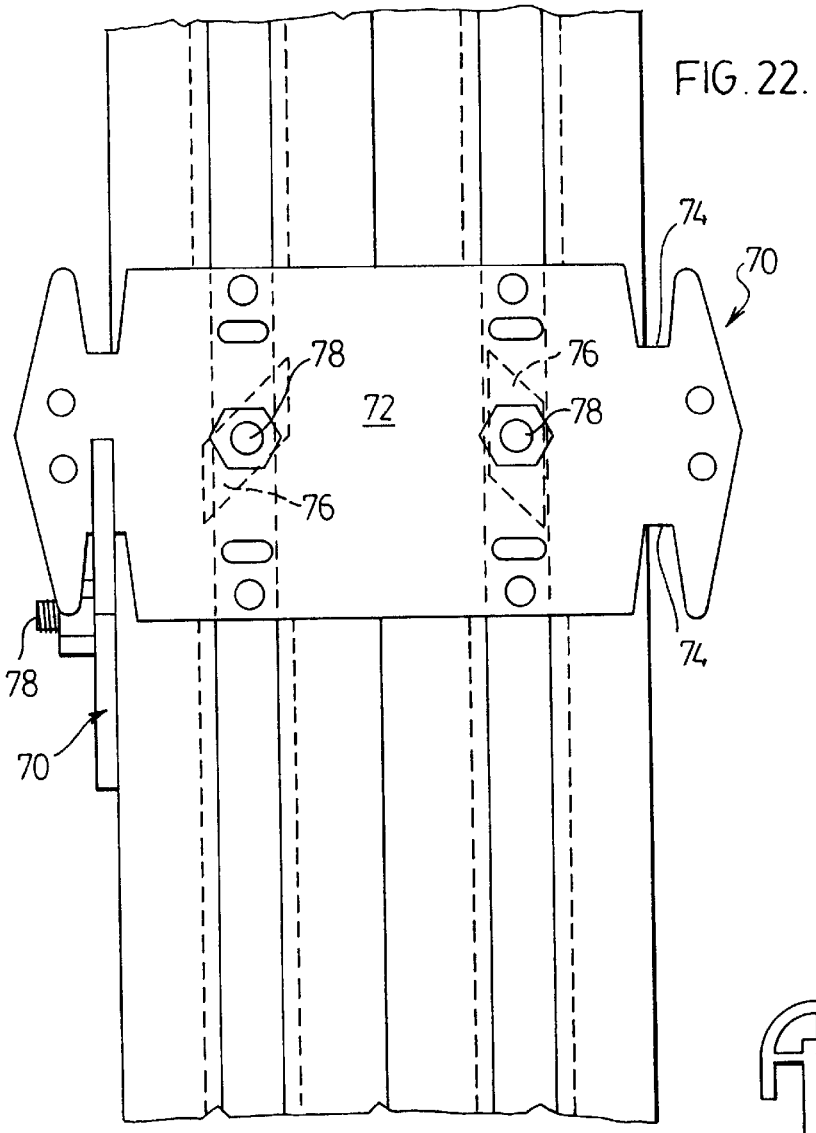
FIG. 22.
FIG. 23.
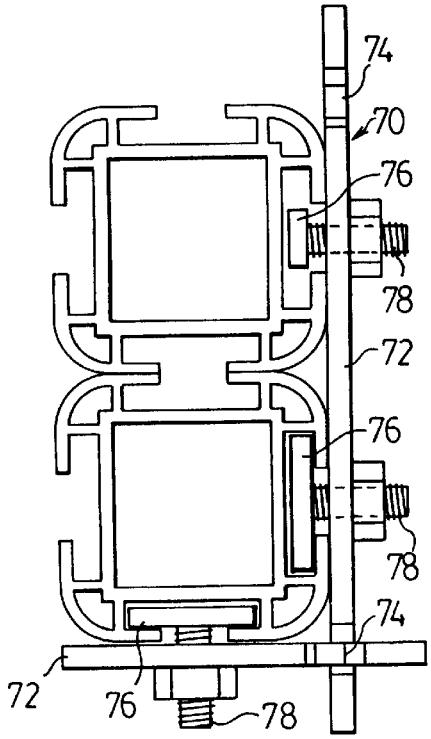

COLLAPSIBLE PANEL AND MODULAR ENCLOSURE AND PARTITION SYSTEM

FIELD OF THE INVENTION

This invention relates to collapsible panels. In particular, this invention relates to a lightweight collapsible panel and a modular system for constructing an enclosure or partition using the collapsible panel.

BACKGROUND OF THE INVENTION

Portable enclosures are used for a number of purposes. One important characteristic of portable enclosures is their lightweight design, and the ability to collapse the enclosure to a small size is an important advantage. Weather resistant enclosures in particular are widely used, finding applications in construction, greenhouses, ice fishing huts, insulated enclosures, disaster relief accommodation, storage sheds, paint spray booths, army and mining exploration accommodation, dust control, and many other uses.

Construction enclosures, for example, are used to facilitate outdoor construction during inclement, and especially cold, weather conditions. Typically the construction crew will erect a scaffold around the construction site and tie tarps to the scaffolding as wind barriers. However, it is difficult to tension the tarps sufficiently to prevent billowing in windy areas, and the insulation and wind-resistance value of such an enclosure is poor because the seams between adjacent tarps can never be uniform or properly sealed. Moreover, tying the tarps is a time consuming and labour intensive task which can add significantly to the cost of the construction.

For other applications such as temporary accommodation and storage, a suitable frame or rigid panels must be used to create a self-standing enclosure that will resist deformation and collapse in windy conditions. Typically such supporting structures and rigid panels are relatively heavy and bulky, increasing the cost of transporting the enclosure from site to site. In each case there must be a balance struck between the weight of the enclosure and its structural integrity.

Collapsible partitions and screens are used in many of the same applications, as well as in space management in offices and commercial premises, theatrical arts, crowd control, awnings, blinds and for many other uses. Again, the competing considerations of weight and structural integrity have rendered the design of such partitions problematic.

SUMMARY OF THE INVENTION

The present invention overcomes these disadvantages by providing a collapsible panel and a modular enclosure and partition system utilizing the collapsible panel, which is particularly useful for portable and weather resistant enclosures and partitions. In a preferred embodiment the enclosure and partition system comprises a series of collapsible panels which connect together to form a weather-resistant enclosure or partition. The collapsible panels are also useful in other applications, such as signs, billboards and the like.

In the preferred embodiment each panel comprises a fabric membrane affixed to an extruded frame, the frame being collapsible in two directions so as to collapse down to a small cross-sectional area when not in use. When the panel is unfolded the membrane is pulled taught, which both imparts structural integrity to the panel, to resist deformation under stress, and prevents billowing of the membrane in windy conditions.

The frames of the panels are preferably extruded with channels for attaching the membrane to the frame and for accommodating connecting members, allowing adjacent panels to be interconnected in a myriad of different configurations and imparting structural integrity to the enclosure or partition. Connecting elements are also provided so that the panels can be connected together to form a self-standing enclosure or partition, or affixed to scaffolding or to any other suitable frame structure for applications which require a particularly large enclosure or partition (which as used herein includes screens, blinds, barriers and the like).

The present invention thus provides a collapsible panel comprising a frame comprising a plurality of frame elements, each frame element having first and second ends, a flexible membrane affixed to the frame elements, such that when the frame is unfolded the membrane lies substantially in a plane defined by a face of the frame, a longitudinal hinge connecting the first ends of frame elements in a first pair of frame elements such that the frame elements in the first pair of frame elements can pivot relative to one another in a direction substantially parallel to the plane, a longitudinal hinge connecting the first ends of frame elements in a second pair of frame elements, such that the frame elements in the second pair of frame elements can pivot relative to one another at the longitudinal hinge in a direction substantially parallel to the plane, a transverse hinge connecting the second ends of one of the frame elements in the first pair and one of the frame elements in the second pair, and a transverse hinge connecting the second ends of the other of the frame elements in the first pair and the other of the frame elements in the second pair, such that the pairs of frame elements can pivot relative to one another in a direction substantially perpendicular to the plane, whereby the panel can be collapsed by folding the first pair of frame elements substantially against the second pair of frame elements and by folding one of the frame elements of each pair substantially against the other of the frame elements of each pair.

The present invention further provides a collapsible panel comprising a frame comprising first, second, third and fourth frame elements, each frame element having first and second ends, a flexible membrane affixed to the frame elements, such that when the frame is unfolded the membrane lies substantially in a plane defined by a face of the frame, a first longitudinal hinge connecting the first ends of the first and second frame elements such that the first and second frame elements can pivot at the longitudinal hinge in a direction substantially parallel to the plane, a second longitudinal hinge connecting the first ends of the third and fourth frame elements, such that the third and fourth frame elements can pivot at the longitudinal hinge in a direction substantially parallel to the plane, a first transverse hinge connecting the second ends of the second and third frame elements such that the second and third frame elements can pivot at the transverse hinge in a direction substantially perpendicular to the plane, and a second transverse hinge connecting the second ends of the fourth and first frame elements such that the fourth and first frame elements can pivot at the transverse hinge in a direction substantially perpendicular to the plane, whereby the panel can be collapsed by folding the first and second frame elements against the third and fourth frame elements at the transverse hinges and by folding the first and fourth frame elements against the second and third frame elements at the longitudinal hinges.

Other objects and advantages of the invention will become apparent from the following description of the preferred embodiments.

BRIEF DESCRIPTION OF THE DRAWINGS

In drawings which illustrate by way of example only a preferred embodiment of the invention, FIG. 1*a* is a schematic perspective view of one embodiment of an enclosure embodying the invention, FIG. 1*b* is a schematic perspective view of one embodiment of a partition embodying the invention, FIG. 2 is a front elevation of a square panel embodying the invention.

FIG. 22 is a side elevation of a connector for the invention,

FIG. 23 is a top plan view of the connector of FIG. 22,

DETAILED DESCRIPTION OF THE INVENTION

Figure 3:
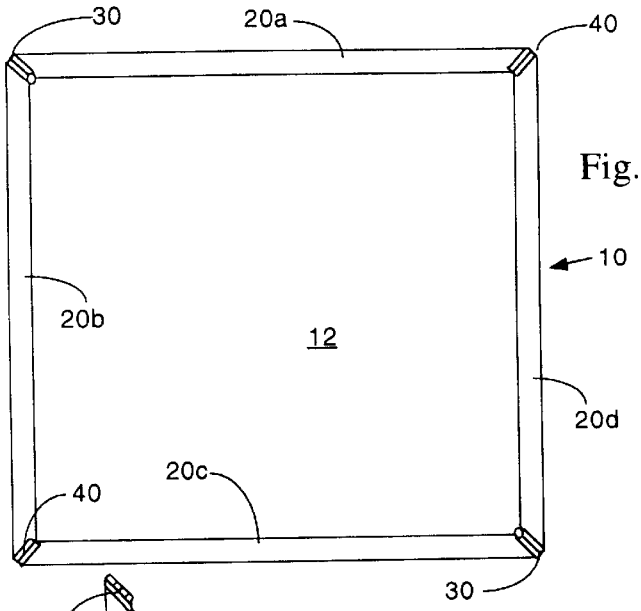
FIG. 3 is a schematic front elevation of an embodiment of the collapsible panel of FIG. 2 in a fully open condition.

The invention provides a collapsible panel, particularly useful for a weather resistant enclosure or partition system, an example of an enclosure according to the invention being illustrated in FIG. 1*a* and an example of a partition according to the invention being illustrated in FIG. 1*b*. It will be appreciated from the following description that there are numerous configurations available for enclosures and partitions constructed according to the invention, and the invention is in no way limited to the particular embodiments shown. Further, it will be apparent that the collapsible panel of the invention is useful for many other applications, and is not restricted to the particular uses described and illustrated herein.

Each panel 10, illustrated in FIG. 2, comprises a flexible membrane 12, the periphery of which is embedded in channels 22 in the frame elements 20 and retained therein by a spline 14 or other suitable fastening means. The membrane 12 may be composed of vinyl, nylon, canvas or any other suitably strong flexible material, which may be (according to the desired application) relatively wind and water impervious. The membrane 12 should be strong enough to resist adverse weather conditions if intended for outdoor use.

Figure 7:
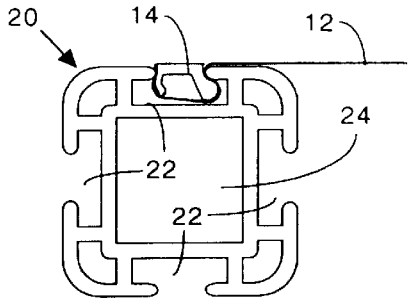
FIG. 7 is a cross-sectional view of a preferred embodiment of the frame element in the collapsible panel of FIG. 2.

A preferred embodiment of the frame elements 20 is illustrated in cross-section in FIG. 7. Each frame element 20 comprises a substantially cross-sectionally symmetrical extruded frame member preferably composed of PVC or ABS or any other suitable plastic, although other materials such as aluminum or wood can also be used for the frame elements 20. In the preferred embodiment illustrated each frame element 20 has a hollow core 24, which serves as a receptacle for the hinges 30, 40, 96 (described below) and, if desired, a rigid core material such as steel or plastic or the like (not shown) may be inserted or injected into the core 24 for imparting increased strength to the frame elements 20. Steel strips or rods (not shown) may also be inserted into unused channels 22 prior to assembly of the frame for this purpose.

Figure 7A:
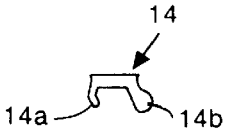
FIG. 7*a* is a cross-sectional view of a preferred embodiment of a spline for the frame element of FIG. 7.

The spline 14 is preferably composed of a semi-rigid material such as plastic. In the embodiment illustrated in FIG. 7*a* the spline 14 is a strip of plastic with a bulbous leg 14*a*, which serves both to grip and to tension the membrane 12 in the channel 22, and a bent or crooked leg 14*b* which depresses slightly to allow for complete insertion of the spline 14 into the channel 22 to retain the membrane 12 and spline 14 in position in the channel 22. It will be appreciated that many other means for fixing the membrane 12 to the frame element 20 are available, including other shapes of spline 14, or by stapling, tacking, bonding, damping or the like, and the invention is not intended to be limited by the particular means shown.

Figure 8:
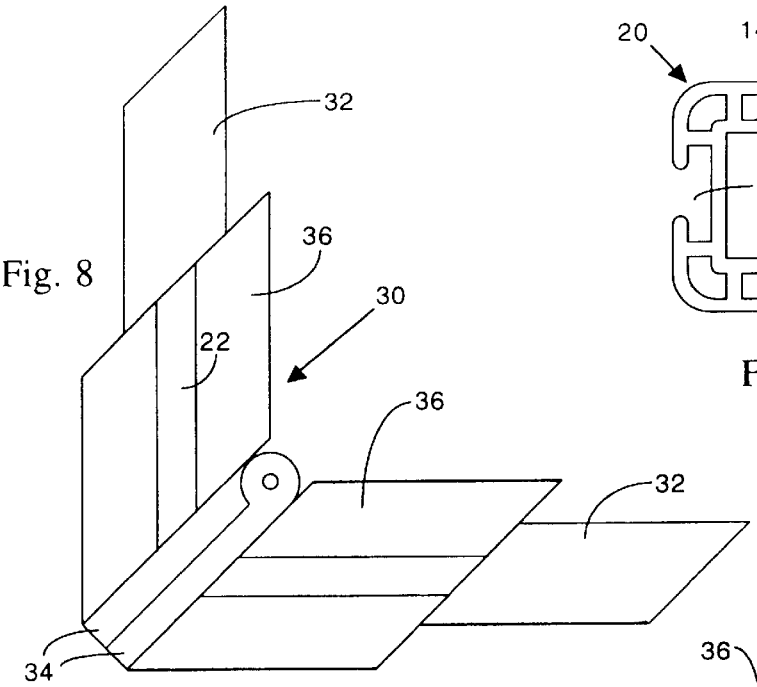
FIG. 8 is a side elevation of a longitudinal hinge for the square panel of FIG. 2.
Figure 9:
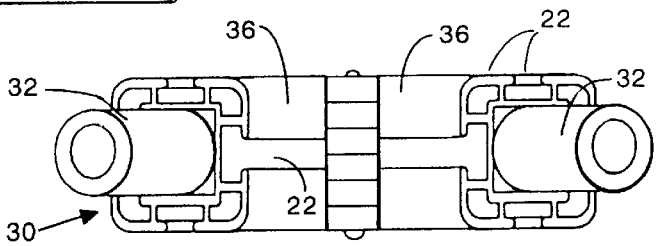
FIG. 9 is an end elevation of the longitudinal hinge of FIG. 8.
Figure 10:
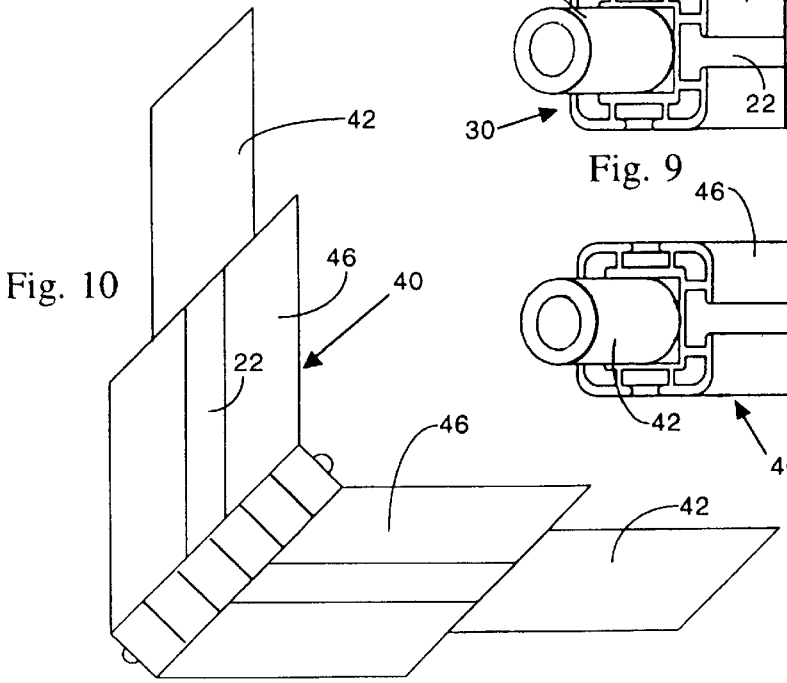
FIG. 10 is a side elevation of a transverse hinge for the panel of FIG. 2.
Figure 11:
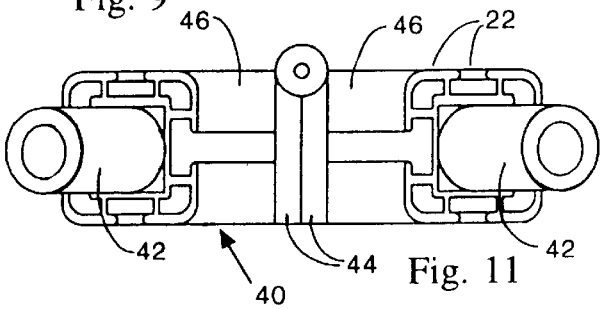
FIG. 11 is an end elevation of the transverse hinge of FIG. 10.

The frame is constructed from four frame elements 20. In the square embodiment shown in FIG. 3 the four frame elements 20 are substantially identical, designated 20*a*, 20*b*, 20*c* and 20*d* for convenience. Adjoining frame elements 20 are alternately connected at their respective ends by longitudinal hinges 30, illustrated in FIGS. 8 and 9, and transverse hinges 40, illustrated in FIGS. 10 and 11.

The longitudinal hinges 30 are adapted to connect to one end of each of the frame elements 20 such that the connected frame elements 20 can pivot toward one another along the plane of the frame, ie. in the direction along which the membrane 12 lies in the unfolded panel 10. The longitudinal hinges 30 are preferably composed of plastic and are provided with spigots 32 projecting at a 45° angle (for the square embodiment shown in FIG. 2) from the back of the hinge plates 34. In the preferred embodiment the spigots 32 are each surrounded by a skirt 36, which is essentially a short piece of extrusion matching the configuration of the frame elements 20 and which is mitred complimentary to the ends of the frame elements 20, at 45° for the embodiment shown in FIG. 2.

The transverse hinges 40 are adapted to connect to the remaining ends of the frame elements 20 so that the frame elements 20 can pivot along a plane perpendicular to the frame, ie. in a direction perpendicular to the membrane 12 in the unfolded panel 10. The transverse hinges 40 are also preferably composed of plastic and are provided with spigots 42 projecting at a 45° angle (for the square embodiment) from the back of the hinge plates 44. Like the longitudinal hinges 30, in the preferred embodiment of the transverse hinges 40 the spigots 42 are each surrounded by a skirt 46 which matches the configuration of the frame elements 20 and is mitred complimentary to the ends of the frame elements 20.

It will be appreciated that the mitred skirts 36, 46 are not essential to the construction of the hinges 30, 40. The hinges 30, 40 can be formed with spigots 32, 42 projecting directly from the hinge plates 34, 34, respectively, at the appropriate angle, so that when the spigots 32 or 42 are inserted into adjacent frame elements 20 the hinge plates 34 or 44 would rest directly against the mitred ends of the frame elements 20.

Figure 4:
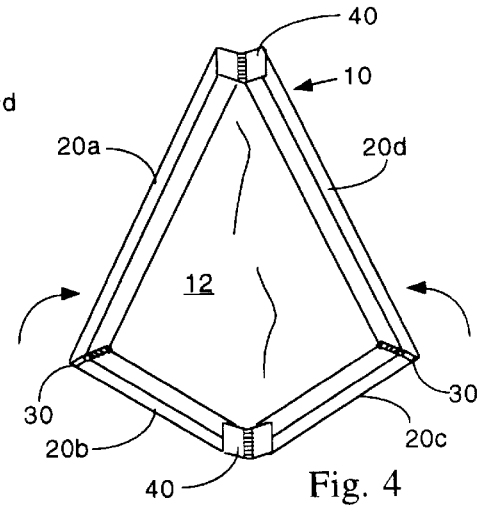
FIG. 4 is a schematic front elevation of the collapsible panel of FIG. 3 shown partially collapsed along a first diagonal.
Figure 5:
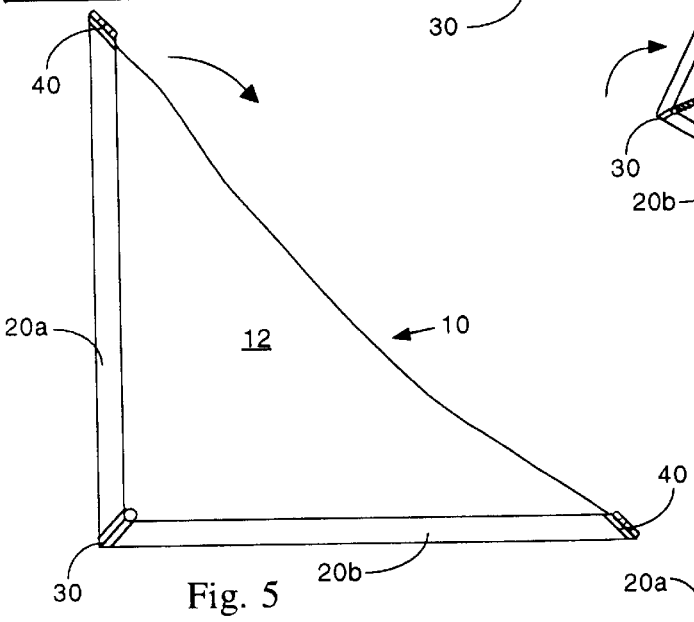
FIG. 5 is a schematic side elevation of the collapsible panel of FIG. 3 shown fully collapsed along the first diagonal.
Figure 6:
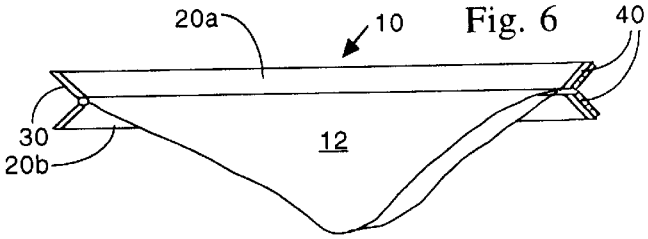
FIG. 6 is a schematic elevation of the collapsible panel of FIG. 3 in a fully collapsed condition.

The manner of collapsing the panel 10 is illustrated in FIGS. 3 to 6, FIG. 3 being a schematic elevation of the opposite face of the panel 10 as illustrated in FIG. 2. As can be seen in FIGS. 2 and 3, the longitudinal hinges 30 are disposed at two diagonally opposite corners of the frame, while the transverse hinges 40 are disposed at the other two diagonally opposite corners. This permits the panel 10 to fold corner-to corner, as illustrated in FIG. 4, in a direction perpendicular to the plane of the unfolded membrane 12. Once the panel 10 has been fully folded along this direction, as shown in FIG. 5, the panel 10 can then be folded at the longitudinal hinges 30 to completely collapse the panel 10, as shown in FIG. 6.

Thus, the frame for the panel 10 of FIG. 2 can be thought of as consisting of two pairs of frame elements 20. First ends of the frame elements 20*a*, 20*b* of the first pair are connected by a longitudinal hinge 30, and likewise first ends of the frame elements 20*c*, 20*d* of the second pair are connected by a longitudinal hinge 30. The pairs are connected together by transverse hinges 40 adjoining the second ends for the frame elements 20, so that the first pair of frame elements 20*a*, 20*b* can be folded in a direction perpendicular to the plane of the unfolded frame, against the second pair of frame elements 20*c*, 20*d*. One of the frame elements 20 within each pair, for example 20*a* and 20*c*, can then be folded against the other of the frame elements 20 within each pair, 20*b* and 20*d*, to completely collapse the panel 10.

In the collapsed condition shown in FIG. 6, the panel 10 occupies a space equivalent to the length of the frame elements 20 with a cross-sectional area approximating the cross-section of the four frame elements 20. With the membrane 12 affixed to the frame, the membrane 12 can be folded or pleated as the panel 10 is being collapsed, and any protruding portion of the membrane 12 (seen in FIG. 6) can be wrapped around the frame to minimize the space occupied by the collapsed panel 10, which is thus ready for transport or storage.

Figure 12:
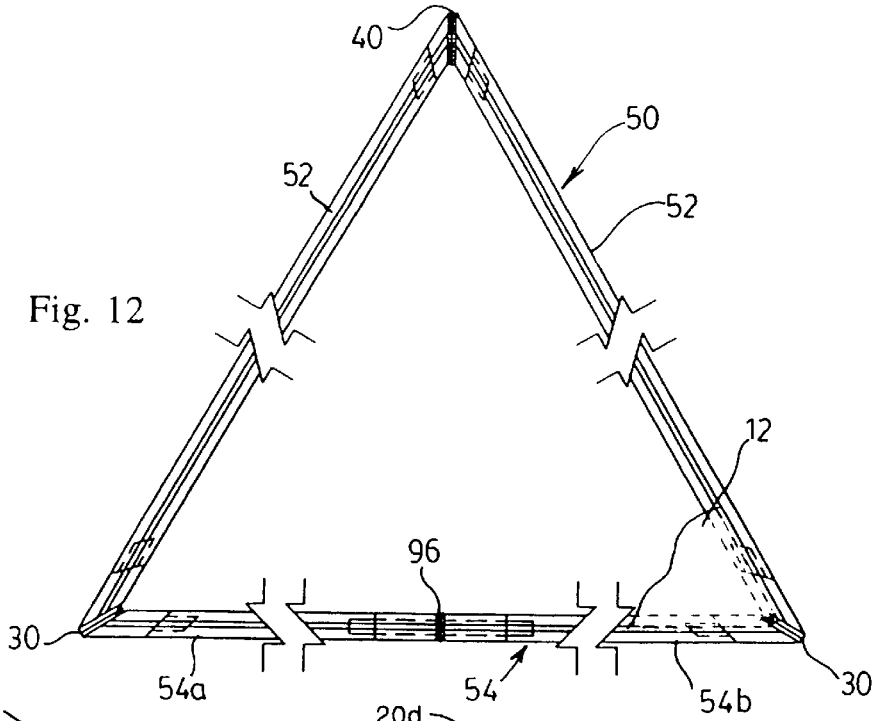
FIG. 12 is a front elevation of a triangular panel embodying the invention.
Figure 13:
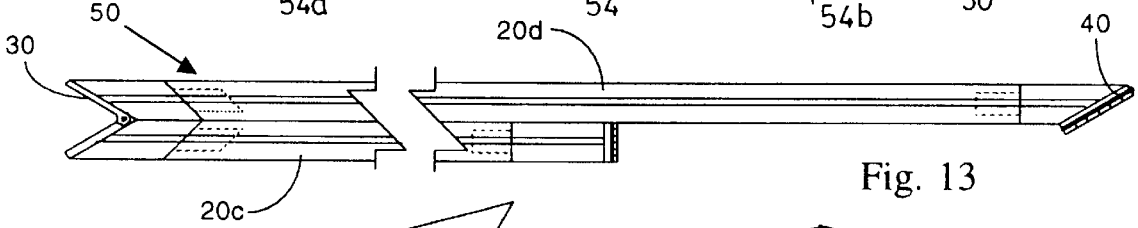
FIG. 13 is a side elevation of the panel of FIG. 12 in a fully collapsed condition.
Figure 14:
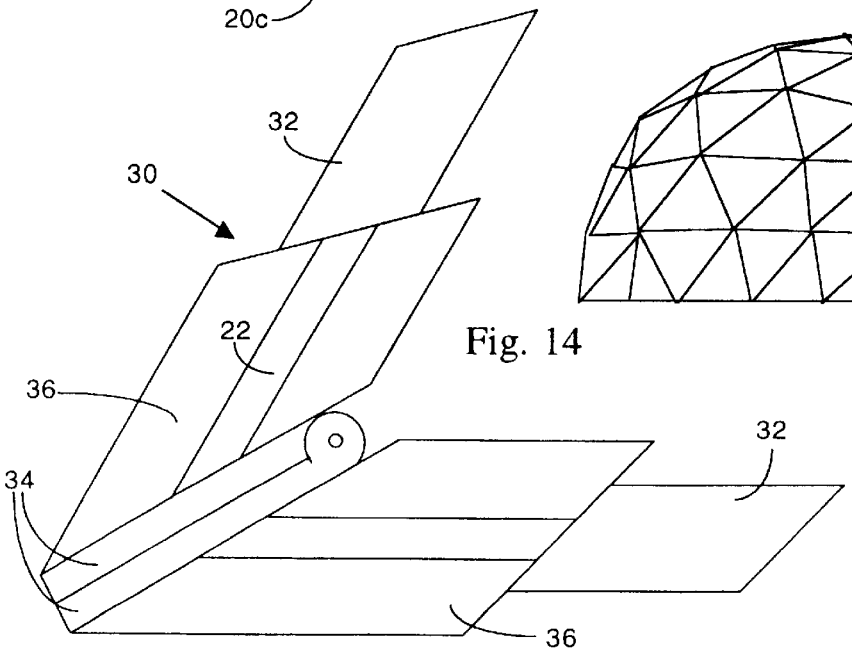
FIG. 14 is a side elevation of a longitudinal hinge for the triangular panel of FIG. 12.
Figure 12A:
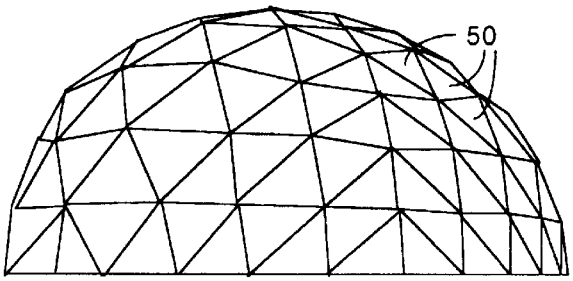
FIG. 12*a* is an elevation of an enclosure embodying the panel of FIG. 12.
Figure 17:
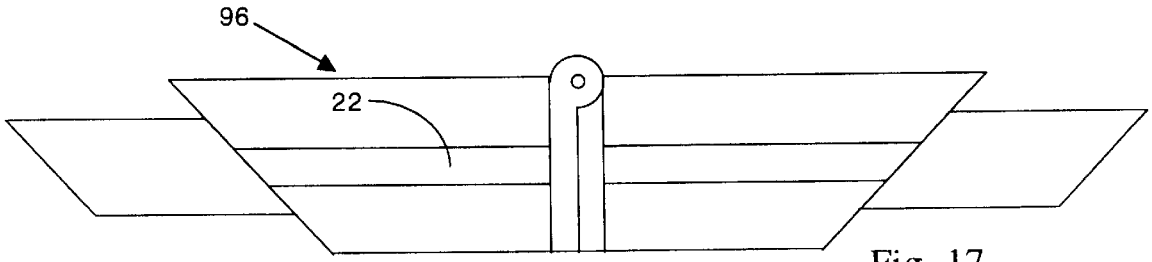
FIG. 17 is a side elevation of a transverse hinge for the triangular panel of FIG. 12 and the rectangular panel of FIG. 15.

A further embodiment of the invention for a collapsible triangular panel 50 is illustrated in FIGS. 12 and 13. The triangular panel 50 is particularly suitable for use as a gable in a portable enclosure roof structure, as in FIG. 1*a*, or in a geodesic structure 58 such as that illustrated in FIG. 12*a*. In this embodiment a frame is composed of two side frame elements 52, and two base frame elements 54*a*, 54*b* which are connected together by a straight transverse hinge 96, illustrated in FIG. 17, at substantially the midpoint of the base to form a base frame member 54. Another transverse hinge 40, in which the spigots 42 project from the hinge plates 44 at a 30° angle (like the longitudinal hinges 30 for this embodiment, illustrated in FIG. 14) to form a 60° transverse hinge 40, connects the adjoining ends of the side frame elements 52 at the apex of the triangle. The side frame elements 52 are in turn respectively connected to the ends of the base frame member 54 by the longitudinal hinges 30 of FIG. 14, so that the panel 50 can be collapsed in substantially the same manner as the square frame shown in FIG. 2.

In this embodiment the first pair of frame elements consists of one side frame element 52 and one base frame element 54*a*, and the other pair of frame elements consists of the other side frame element 52 and the other base frame element 54*b*. As in the square panel 10, the frame is collapsed by folding the first pair of frame elements 52, 54*a* substantially against the second pair of frame elements 52, 54*b*, and then folding one frame element of each pair, for example the base frame elements 54*a*, 54*b*, against the other frame element 52 of each pair. The collapsed frame 50 is shown in FIG. 13.

Figure 15:
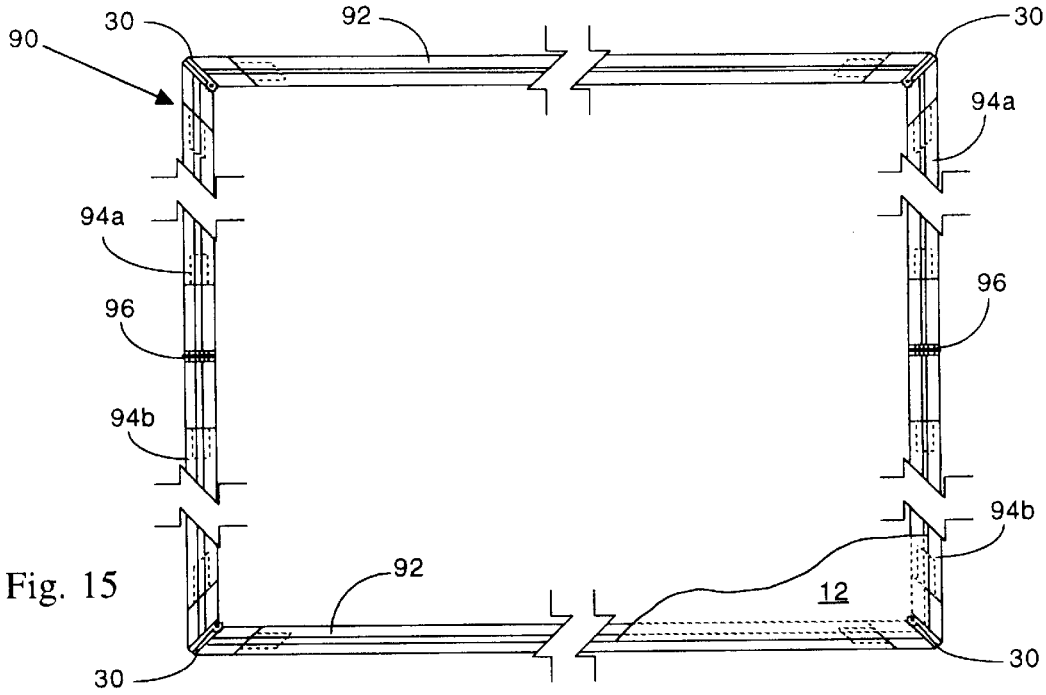
FIG. 15 is a front elevation of a rectangular panel embodying the invention.
Figure 16:
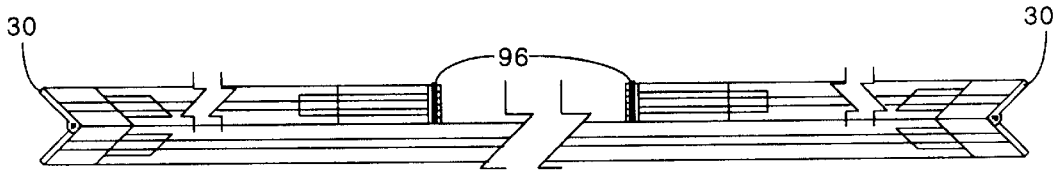
FIG. 16 is a side elevation of the rectangular panel of FIG. 15 in a fully collapsed condition.

FIGS. 15 and 16 illustrate a rectangular panel 90 embodying the invention. This embodiment uses 90° longitudinal hinges 30 at the four corners of the frame, as in the square embodiment of FIG. 2. The two side frame members 94 are composed of substantially identical components 94*a*, 94*b* connected together by the straight transverse hinges 96 of FIG. 17. The other ends of the components 94*a*, 94*b* are in turn connected to the top and bottom frame members 92. This embodiment collapses in a manner similar to the triangular embodiment, by folding the top half of the frame down along the transverse hinges 96 and then collapsing the side components 94*a*, 94*b* onto the top and bottom frame members 92. In this embodiment the two pairs of frame elements can be thought of as consisting of a first frame element, being one of the side components 94*a* or 94*b*, and a second frame element comprising the combination of the other side component 94*a* or 94*b* and a frame member 92. The collapsed rectangular frame is illustrated in FIG. 16. (It will be appreciated that the designations "top", "bottom" and "side" are for purposes of reference to the drawings only, and that the rectangular panel 90 can be oriented in any desired fashion, eg. with the transverse hinges 90 along the top and bottom of the frame).

The assembly of the collapsible panel of the invention will now be described with reference to the square panel 10 of FIG. 2, in which the first, second, third and fourth frame elements 20 have been respectively designated 20*a*, 20*b*, 20*c*and 20*d* for ease of reference. It will be appreciated that the described assembly procedure applies equally to the triangular panel 50 illustrated in FIG. 12 and the rectangular panel 90 illustrated in FIG. 15.

The first longitudinal hinge 30 is connected to the first ends of the first and second frame elements 20*a*, 20*b*, by inserting the two spigots 34 into the cores 24 of the frame elements 20*a*, 20*b*, oriented such that the first and second frame elements 20*a*, 20*b* can pivot toward one another at the longitudinal hinge 30, ie. in a direction substantially parallel to the plane of the unfolded panel 10. The second longitudinal hinge 30 is inserted to connect the first ends of the third and fourth frame elements 20*c*, 20*d*, oriented such that the third and fourth frame elements 20*c*, 20*d* can similarly pivot toward one another at the longitudinal hinge 30. The longitudinal hinges 30 will thus be disposed at diagonally opposite corners in the assembled frame.

The first transverse hinge 40 is inserted to connect the second ends of the second and third frame elements 20*b*, 20*c*, by inserting the spigots 44 into the cores 24 of the frame elements 20*b*, 20*c*, oriented such that the second and third frame elements 20*b*, 20*c* can pivot toward one another at the transverse hinge 40, in a direction substantially perpendicular to the plane of the unfolded panel 10. The second transverse hinge 40 is likewise inserted to connect the second ends of the fourth and first frame elements 20*d*, 20*a*, oriented such that the fourth and first frame elements 20*d*, 20*a* can pivot toward one another at the transverse hinge 40, in the same direction as the second and third frame elements 20*b*, 20*c*. It will thus be seen that the transverse hinges 40 also end up being disposed at diagonally opposite corners of the assembled frame.

Preferably the hinges 30, 40 are bonded or otherwise permanently affixed to the respective ends of the frame elements 20, to avoid separation from or twisting within the ends of the frame elements 20 in the assembled frame.

The flexible membrane 12 is affixed to the frame elements 20 by laying the membrane material over the unfolded frame and inserting the bulbous leg 14*a* of a suitable length of spline 14 into the channel 22. Using a mallet or other means, the spline 14 is then fully set into the channel 22 by depressing the side of the spline with the crooked leg 14*b* into the channel 22 so that the spline 14 is positioned as shown in FIG. 7. This procedure is repeated around the entire frame, which ensures that when the frame is unfolded the membrane 12 is pulled taught across the face of the frame 20. The excess membrane material is then trimmed away with a cutting knife.

With this construction the panel 10 can be collapsed by folding the first pair of frame elements 20*a*, 20*b* against the second pair of frame elements 20*c*, 20*d* at the transverse hinges 40 (ie. along the diagonal extending between the transverse hinges 40), and then folding one of the frame elements in each pair, for example 20*a*and 20*d*, against the other frame elements 20*b*, 20*c* at the longitudinal hinges 30, with the membrane 12 still fixed in position. The panel 10 is unfolded by reversing this procedure.

Various connecting elements are provided for interconnecting adjacent panels 10 and for clamping the panels to supporting structures such as scaffolding 88. In the preferred embodiment the connectors are adapted to snap-fit or clamp into the unused channels 12 in the frame elements 20, 50 or 90.

FIGS. 22 and 23 illustrate an interlocking connector 70 having a main plate 72 with slots 74 into which a like connector 70 can attach in a slip-fit relation in the manner illustrated. A wing 76 (shown in phantom in FIG. 22) having a width sufficiently small to enable it to pass into the channel 22, as illustrated in the upper portion of the figure in FIG. 23, is rotatably affixed to the main plate 72 by bolt 78, so that as the bolt 78 is rotated the wing 76 turns within the channel 22, as shown in the lower portion of FIG. 23, to lock the connector 70 in place. These connectors 70 can be used for slip-fit assembly of adjacent panels in an enclosure or partition.

Figure 18:
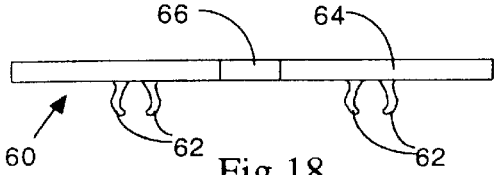
FIG. 18 is an end elevation of a connecting strip for the invention.
Figure 19:
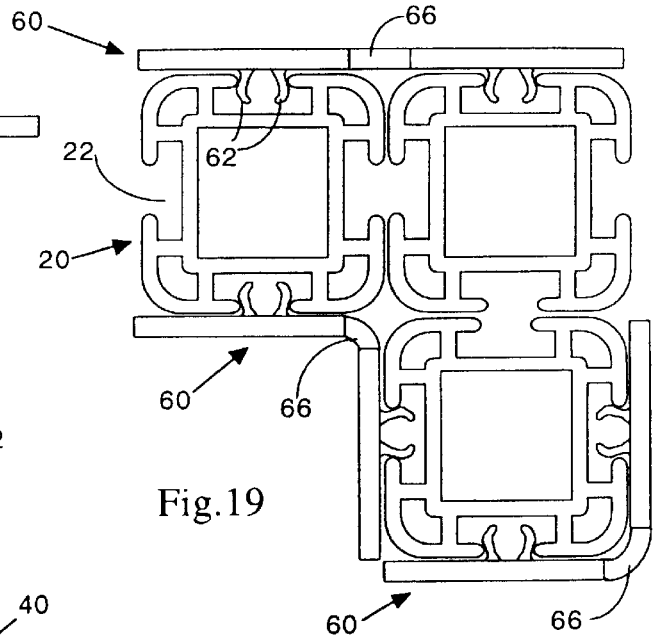
FIG. 19 is a cross-sectional view of connecting strips of FIG. 18 attached to the frame elements.

For enclosures or partitions in which a more positive locking connection between adjacent panels is desired, the invention provides a connector strip 60 having two pairs of opposed resilient barbed or crooked legs 62 which cam against the entrance to the channel 22, to detachably snap into any unused channels 22 in adjacent frame elements 20 at any desired position, as shown in FIG. 18. The connector strips 60 have a main plate 64 from which the legs 62 project, which is preferably composed of a semi-rigid plastic and may be cut to length to suit the application, longer strips 60 providing a stronger connection. Preferably the connector strip 60 is moulded or extruded with a flexible region 66 in the main plate 64 between the pairs of crooked legs 62, to both facilitate insertion of the legs 62 into adjacent frame elements 20 and to allow for corner connections, variations of which are shown in FIG. 19.

It will be appreciated that once adjacent square panels 10 are connected together in the manner shown, the panels 10 will not collapse inadvertently. Each panel must first be collapsed at the transverse hinges 40, which requires that each panel 10 be folded at a 45° angle relative to the bottom of the frame (ie. along a diagonal of the panel 10). Once adjacent panels 10 are connected, each panel 10 prevents the adjacent panel 10 from folding at this angle. The interconnection of panels thus imparts structural integrity to the partition or enclosure, each panel 10 serving to retain adjacent panels in a fully open and properly squared configuration. Taught membranes 12 also serve to increase the integrity of the overall structure.

Figure 20:
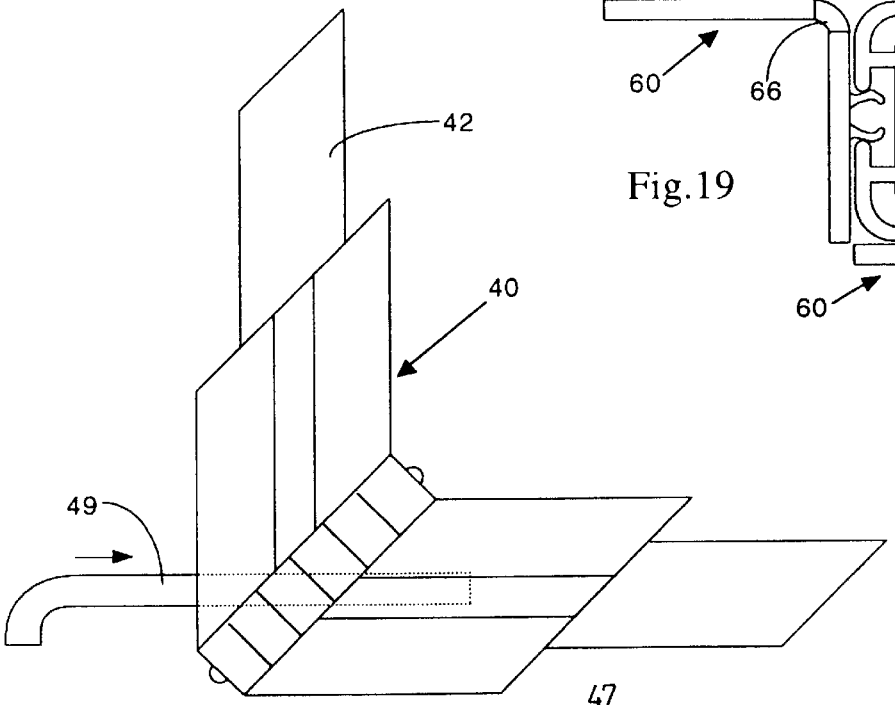
FIG. 20 is a side elevation of a variation of the transverse hinge showing one method of locking the hinge.
Figure 21:
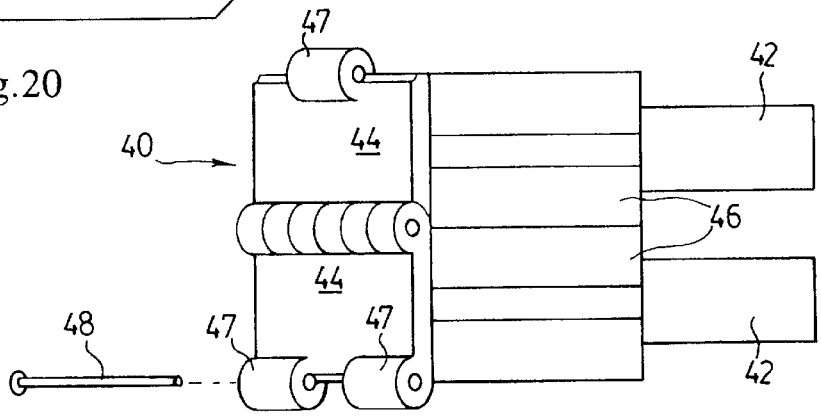
FIG. 21 is a side elevation of a further variation of the transverse hinge showing another method of locking the hinge.

For additional resistance to collapsing, by reducing the stress on the transverse hinges 40, the locking means illustrated in FIG. 20 may be used. FIG. 20 illustrates a transverse hinge 40 in which a hole has been bored or formed through the hinge plates 44, allowing a steel locking pin 49 to be inserted into the hinge 40 to retain it in the closed position (ie. panel unfolded; the hinge 40 opens as the panel is collapsed). FIG. 21 illustrates a transverse hinge 40 in which a pair of knuckles 47 has been formed on the hinge plates 44 on the side opposite the hinge pin, allowing a steel pin 48 to be inserted into the knuckles 47 to retain the hinge 40 closed and thus lock the panel in the unfolded position. These embodiments of the transverse hinges 40 or 96 are also particularly useful for applications involving single panels, such as dividers, signs and billboards.

The rectangular panels 90 do not inherently prevent premature or inadvertent collapse, because adjacent panels can still fold along the transverse hinges 96 even when connected side-by-side. The locking feature illustrated in FIG. 21, or similar locking means, can be used in this embodiment to prevent inadvertent collapsing of the panels 90.

Figure 24:
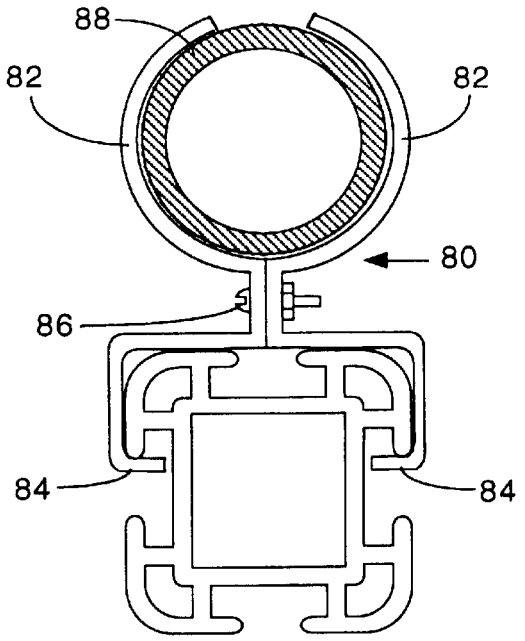
FIG. 24 is a top plan view of a clamp for affixing panels of the invention to a scaffold or other support structure.

FIG. 24 illustrates a preferred embodiment of a clamp 80 for affixing the unfolded panels 10, 50 or 90 to a supporting structure such as scaffolding 88 or the like, an example of which is illustrated in FIG. 1*b*. The damp 80 comprises opposed arms 82 each having a semi-circular or crescent-shaped jaws 82 for gripping the tubular members of the supporting structure 88 and a return flange 84 which nests in an unused channel 22 as shown. A bolt 86 clamps the two arms together to retain the panel 20 or 50 in position against the supporting structure 88.

Services such as electrical wiring (not shown) may be passed through the hollow cores 24 of the frame elements 20, or may be laid into unused channels 22 and covered by a connecting strip 60 or by a narrower capping strip (not shown) which snap-fits into the channel 22 in a manner similar to the connecting strips 60.

Figure 25:
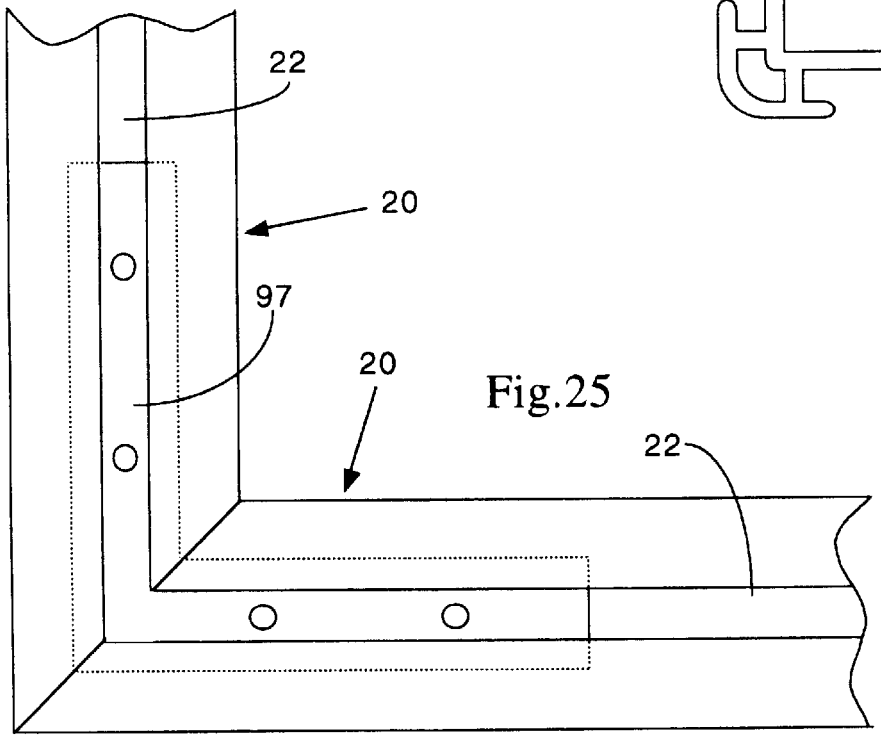
FIG. 25 is a side elevation of a fixed corner for a knock-down embodiment of the panel of the invention.

If a fixed (non-collapsible) panel is desired for any reason, for example as a door in an enclosure of the invention, the ends of adjacent frame elements 20 can be connected by inserting steel corner brackets 97 into the channels 22, as shown in FIG. 25. The resulting panel cannot collapse, but can be knocked-down to its constituent parts after the membrane has been removed from the panel.

The connecting strip 60 can be used as a hinge for a door or the like. With its resilient center portion 66 the connecting strip 60 will act as a return hinge, biasing the door to a closed position. The connecting strip 60 can be similarly used wherever a flexible connection between panels is required, for example to adjoin two sign panels along their top edges for a collapsible "sandwich board" sign. Short sections of the connecting strip 60 can be slid along the frame elements 20 while still engaged in the channel 22, which can be advantageous for positioning such hinges.

The collapsible panel of the invention can be made to virtually any suitable size, smaller panels being useful for such articles as signs (graphic and text matter can be applied to the membrane 12 in a conventional fashion) and packaging enclosures, and larger panels being useful for enclosures for accommodation, wind screens and the like. An enclosure embodying the invention can be readily insulated using standard foam sheets such as Styrofoam™, where thermal insulation is desired.

A preferred embodiment of the invention having been thus described by way of example only, it will be apparent to those skilled in the art that certain modifications and adaptations may be made without departing from the scope of the invention, as set out in the appended claims.

I claim:

1. A collapsible panel comprising a frame comprising a plurality of frame elements, each frame element having first and second ends, a flexible membrane affixed to the frame elements, such that when the frame is unfolded the membrane lies substantially in a plane defined by a face of the frame, a longitudinal hinge connecting the first ends of the frame elements in a first pair of the frame elements such that the frame elements in the first pair can pivot relative to one another in a direction substantially parallel to the plane, a longitudinal hinge connecting the first ends of the frame elements in a second pair of the frame elements, such that the frame elements in the second pair can pivot relative to one another at the longitudinal hinge in a direction substantially parallel to the plane, and a transverse hinge connecting the second ends of one of the frame elements in the first pair and one of the frame elements in the second pair, and a transverse hinge connecting the second ends of the other of the frame elements in the first pair and the other of the frame elements in the second pair, such that the pairs of frame elements can pivot relative to one another in a direction substantially perpendicular to the plane, whereby the panel can be collapsed by folding the first pair of frame elements substantially against the second pair of frame elements and by folding one of the frame elements of each pair substantially against the other of the frame elements of each pair.

2. The collapsible panel of claim 1 in which the frame is square.

3. The collapsible panel of claim 1 in which each frame element is provided with at least one channel affixing the membrane thereto.

4. The collapsible panel of claim 3 in which the membrane is affixed into the channel using a plastic spline.

5. The collapsible panel of claim 1 in which the longitudinal and transverse hinges each comprise hinge plates affixed to a skirt from which a spigot projects connecting the hinges to the frame elements.

6. The collapsible panel of claim 1 in which at least one of the transverse hinges is provided with means for locking the transverse hinge in an open position.

7. The collapsible panel of claim 1 in which the frame elements and the hinges are composed of plastic.

8. A plurality of the collapsible panels of claim 1 connected together to form an enclosure or partition.

9. A collapsible panel, comprising a frame comprising first, second, third and fourth frame elements, each frame element having first and second ends, a flexible membrane affixed to the frame elements, such that when the frame is unfolded the membrane lies substantially in a plane defined by a face of the frame, a first longitudinal hinge connecting the first ends of the first and second frame elements such that the first and second frame elements can pivot at the longitudinal hinge in a direction substantially parallel to the plane, a second longitudinal hinge connecting the first ends of the third and fourth frame elements, such that the third and fourth frame elements can pivot at the longitudinal hinge in a direction substantially parallel to the plane, a first transverse hinge connecting the second ends of the second and third frame elements such that the second and third frame elements can pivot at the transverse hinge in a direction substantially perpendicular to the plane, and a second transverse hinge connecting the second ends of the fourth and first frame elements such that the fourth and first frame elements can pivot at the transverse hinge in a direction substantially perpendicular to the plane, whereby the panel can be collapsed by folding the first and second frame elements against the third and fourth frame elements at the transverse hinges and by folding the first and fourth frame elements against the second and third frame elements at the longitudinal hinges.

10. The collapsible panel of claim 9 in which the frame is square.

11. The collapsible panel of claim 9 in which each frame element is provided with at least one channel affixing the membrane thereto.

12. The collapsible panel of claim 11 in which the membrane is affixed into the channel using a plastic spline.

13. The collapsible panel of claim 9 in which the longitudinal and transverse hinges each comprise hinge plates affixed to a skirt from which a spigot projects connecting the hinges to the frame elements.

14. A plurality of the collapsible panels of claim 9 connected together to form an enclosure or partition.

15. The collapsible panel of claim 9 in which the frame elements and the hinges are composed of plastic.

16. A plurality of the collapsible panels of claim 10 connected together to form an enclosure or partition.

* * * * *